US008348360B2

(12) United States Patent
L'Hotel

(10) Patent No.: US 8,348,360 B2
(45) Date of Patent: Jan. 8, 2013

(54) ELEMENTARY SUPPORT FOR OBJECT DISPLAY COMPRISING A HINGE POLYHEDRAL COMPARTMENT

(76) Inventor: François L'Hotel, Larchant (FR)

( * ) Notice: Subject to any disclaimer, the term of this patent is extended or adjusted under 35 U.S.C. 154(b) by 792 days.

(21) Appl. No.: 12/402,654

(22) Filed: Mar. 12, 2009

(65) Prior Publication Data

US 2009/0230829 A1 Sep. 17, 2009

(30) Foreign Application Priority Data

Mar. 12, 2008 (FR) ..... 08 01347

(51) Int. Cl.
*A47B 43/00* (2006.01)

(52) U.S. Cl. ..... 312/259; 206/805

(58) Field of Classification Search ..... 312/258, 312/259, 260, 261, 262, 257.1; 206/805, 206/736, 730; 220/6, 62; 229/125.38, 125.39, 229/117.03, 125
See application file for complete search history.

(56) References Cited

U.S. PATENT DOCUMENTS

| | | | | |
|---|---|---|---|---|
| 1,216,071 | A * | 2/1917 | Carstensen | 229/122 |
| 1,871,706 | A * | 8/1932 | Krebs | 206/45.29 |
| 3,010,246 | A * | 11/1961 | England | 446/148 |
| 3,300,166 | A | 1/1967 | Wojciechowski | |
| 3,385,424 | A * | 5/1968 | Thompson et al. | 206/756 |
| 3,391,848 | A * | 7/1968 | Schmidt | 229/198.1 |
| 3,576,354 | A * | 4/1971 | Stone et al. | 312/258 |
| 3,933,300 | A * | 1/1976 | Dempster | 229/117.17 |
| 3,987,957 | A * | 10/1976 | Johnson | 229/152 |
| 4,335,830 | A * | 6/1982 | Garganese | 229/164.2 |
| 4,619,426 | A * | 10/1986 | Drueck, Jr. | 248/174 |
| 4,854,060 | A * | 8/1989 | Corbo et al. | 40/720 |
| 5,887,782 | A * | 3/1999 | Mueller | 229/183 |
| 2002/0171023 | A1 | 11/2002 | L'Hotel et al. | |
| 2008/0257843 | A1 | 10/2008 | L'Hotel | |

FOREIGN PATENT DOCUMENTS

| | | |
|---|---|---|
| CA | 975961 | 10/1975 |
| EP | 0 231 530 | 8/1987 |
| FR | 2847062 | 5/2004 |
| GB | 467854 | 6/1937 |
| WO | WO 2004/027737 | 4/2004 |
| WO | WO 2005/004677 | 1/2005 |

* cited by examiner

*Primary Examiner* — James O Hansen
*Assistant Examiner* — Matthew Ing
(74) *Attorney, Agent, or Firm* — Novak Druce + Quigg LLP

(57) ABSTRACT

A support can provide information and display objects. The compartment of the support is hinged to switch between a flat folded condition and an unfolded and open functional condition to receive an object. It comprises a retractable wall (115) for holding the compartment in its unfolded and open condition and an elastic element (127) for biasing the holding wall in an unretracted holding position. The flattening of the compartment is done by retracting the holding wall against the action of an elastic element. The pivoting holding retracting wall (115) is a shoring wall between a floor face (105) and a ceiling face (103) with which they form a force descending rod.

10 Claims, 3 Drawing Sheets

ELEMENTARY SUPPORT FOR OBJECT DISPLAY COMPRISING A HINGE POLYHEDRAL COMPARTMENT

CROSS-REFERENCE TO RELATED APPLICATIONS

This application claims priority to French Application No. 0801347, filed Mar. 12, 2008, the entirety of which is incorporated herein by reference.

FIELD OF THE INVENTION

The field of the invention relates to displays being foldable on themselves and quasi-automatically unfoldable, with the advantage of being able to be transported and stored in excellent conditions, on one hand, and to be quickly installed on site, on the other hand.

DETAILED DESCRIPTION

From a folded condition, one just has to start unfolding the support so that, under the action of elastic biasing means, it unfolds in a fully automatic way.

Of course, conversely, the folding of the support is done against the action of the biasing means.

The Applicant has developed such displays for a long time.

He started with information support displays. Such displays can be useful for visual communication or advertisement on sales sites, designed by PLV, and can be presented in column form. Such displays are described in document FR 2,824,946.

Then, the Applicant proposed support displays the inner space of which, in the expanded condition, is left free so as to be able to slide an object inside or to slide the support around an object, projecting or not from the support. These displays are described in the French patent application 07 02 817 of Apr. 18, 2007.

Furthermore, the Applicant had already proposed information support columns for PLV also allowing for the reception of objects, such as those described in the document FR 2,847,062.

Now, the Applicant proposes displays made on a similar principle, but firstly intended to support or present objects and, incidentally, information.

One already knows from document WO2005/004677, an elementary support for object display comprising a polyhedral compartment hinged to switch between a flat folded condition and an unfolded and open functional condition to accommodate an object, retractable means for holding the compartment in its unfolded and open condition and elastic means for biasing the holding means in a holding non retracted position, the flattening of the compartment occurring by retracting the holding means against the action of the elastic means.

It will be recalled that a polyhedron is a body with planar faces.

However, the compartment of the prior document does not allow to support a body or any object of an important weight.

Thus, the invention of the present application first relates to an elementary support of the type defined hereunder, characterized in that the compartment comprises a polyhedral sleeve with hinge edges and at least one pivoting holding retractable wall, the hinge edges bounding a floor face and a ceiling face of the compartment and the pivoting holding retractable wall being arranged to provide, between these ceiling and floor faces, a shoring function.

The holding wall is a retractable shoring wall.

Under those conditions, the compartment can easily support on the ceiling surface a body or any object of an important weight, or even another elementary support and indeed a plurality of those supports.

In other words, in the unfolded and open condition of the compartment, the ceiling face and the shoring wall form, up to the floor, a force descending rod.

In a first embodiment, the holding wall is pivotally mounted around an edge being orthogonal to the hinge edges and outer to the polyhedral sleeve.

In other embodiments, the holding wall is pivotally mounted around an edge inside the sleeve.

In the first embodiment, the support comprises a single compartment; in the other embodiments, it can comprise two of them.

In a particular embodiment, the holding wall is pivotally mounted around an edge parallel to the hinge edges.

In this compartment, the holding wall can be recessed as the compartment faces that are parallel to it in the folded and unfolded conditions of the compartment.

Still in that compartment, secondary holding walls can be provided freely pivotally mounted around outer edges of the polyhedral sleeve.

The invention also relates to a set of several elementary supports such as those defined above.

This invention will be better understood from the following description of several embodiments of the elementary support and of the set of elementary supports of the invention, with reference to the accompanying drawings, in which:

DETAILED DESCRIPTION OF THE DRAWINGS

Figure 1:
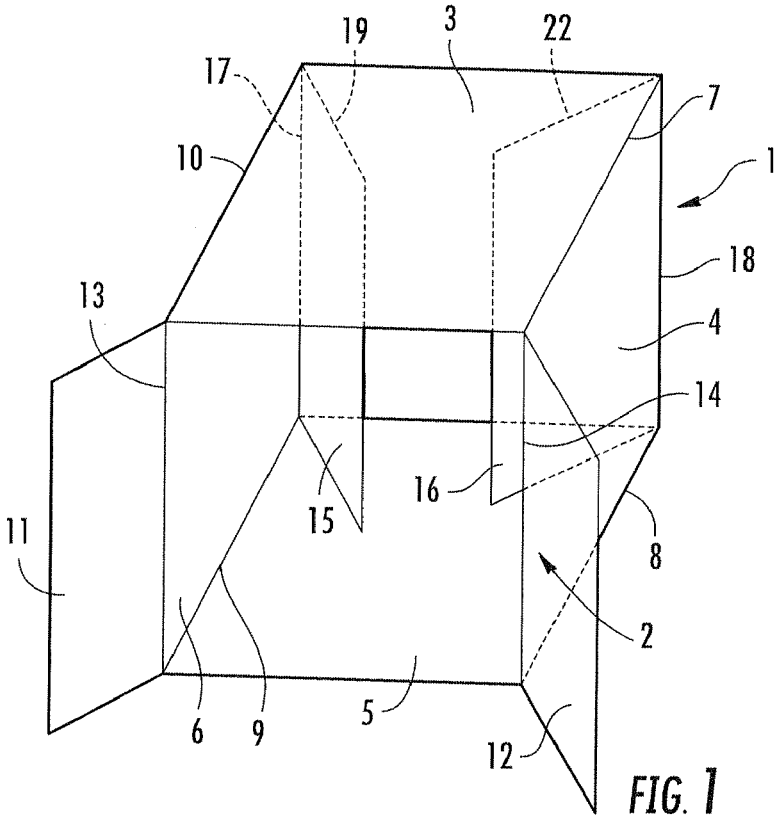
FIG. 1 is a front perspective view of a first embodiment of the display elementary support.
Figure 2:
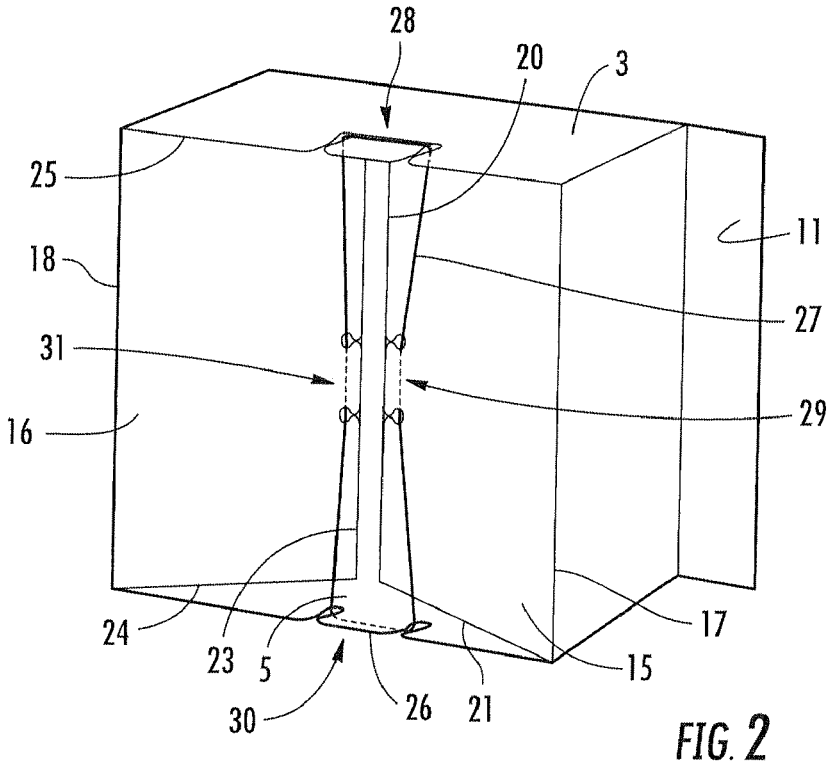
FIG. 2 is a back perspective view of the support of FIG. 1.

Referring to FIGS. 1 and 2, a first embodiment of the display elementary support of the invention will now be described. It is a polyhedral compartment 1, a parallelepiped to be specific, with a sleeve 2 with four faces 3-6 joined by their common edges 7-10 constituting the hinge edges.

On one hand, the sleeve 2 is almost open, with only two small flaps 11, 12 hinged around two edges 13, 14 of the two opposite faces 6, 4 of the compartment 1, the edges 13, 14 being perpendicular and orthogonal to the hinge edges 7-10. On the other hand, the sleeve 2 can be closed by two retractable flaps 15, 16 for holding the compartment 1 in an unfolded and open condition, as it will be now explained.

Both holding flaps 15, 16 are pivotally mounted around the two edges 17, 18 of the faces 6, 4 opposed to the hinge edges 13, 14 of the two anterior flaps 11, 12. The sum of their widths is substantially equal to the width of the sleeve 2 in the open condition, i.e. the width of both floor 5 and ceiling 3 faces of the sleeve 2.

Indentations are arranged from the three free flanges 19, 20, 21 and 22, 23, 24 of both holding flaps 15, 16 as well as from the back flanges 25, 26 of the faces 3, 5, those indentations being terminated by eyelets receiving a biasing elastic 27. Thus, the elastic 27 is passed through a pair of eyelets 28 of the face 3, near the flange 25, a pair of eyelets 29 of the flap 15, near its flange 20, a pair of eyelets 30 of the face 5, near the flange 26, and a pair of eyelets 31 of the flap 16, near its flange 23.

Thus, the compartment 1 can switch between a flat folded condition and an unfolded and open functional condition to receive an object in its single compartment. When flat, the faces of the sleeve 2 are in pairs one on the other 3, 4 and 5, 6 after pivoting around the four hinge edges 7-10. The sleeve is held in the open condition by holding flaps 15, 16 pivoting around the outer edges 17, 18, orthogonal to the hinge edges, under the action of the elastic 27, which has disposed the four pairs of eyelets 28-31 substantially in a common plane to reduce its tension, the flanges 19, 21 and 22, 24 of both flaps 15, 16 substantially entering the plane of both flanges 25, 26 to serve as an abutment to both faces 3, 5. Both flaps are then in an unretracted holding position and provide a shoring function between the floor face 5 and the ceiling face 3.

The flattening of the compartment 1 (of the sleeve 2) is done by retracting the flaps 15, 16, that is by having them pivoting around their edges 17, 18, against the action of the biasing elastic 27, and by folding them against the interior of the faces 6, 4.

Naturally, a plurality of compartments like the compartment 1 which has just been described can be stacked or juxtaposed one on the other or one near the other by any appropriate securing means, for instance by sticking.

Figure 3:
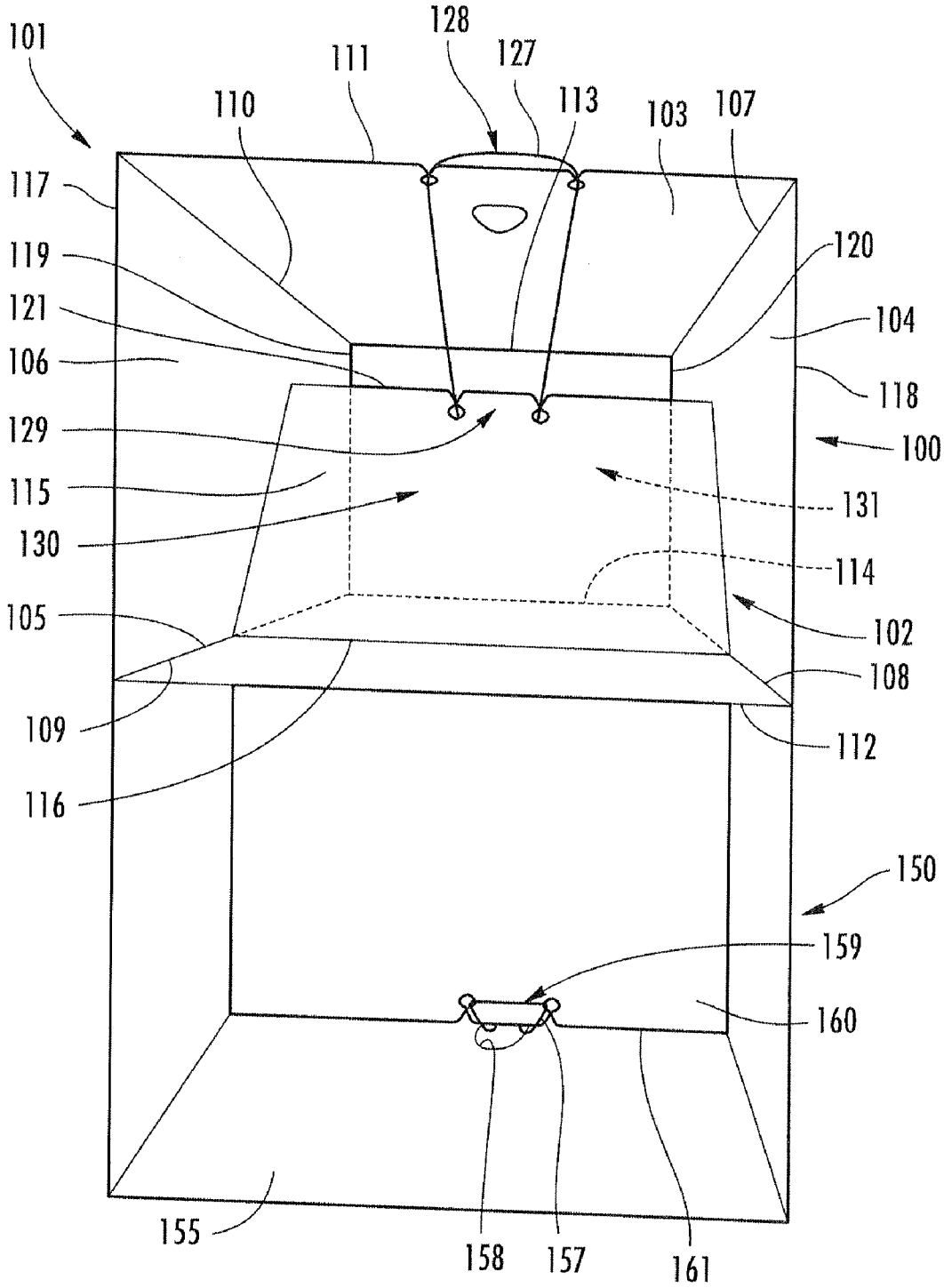
FIG. 3 is a front perspective view of a set of two second embodiments of the display elementary support.

Referring to FIG. 3, a set of two second embodiments of the display elementary support of the invention will now be described. The element 100, represented above the other 150 on FIG. 3—both elements only differ by the biasing elastic securing—is also a parallelepiped compartment 101, with a sleeve 102 with four faces 103-106 joined by their common edges 107-110 constituting hinge edges.

A retractable holding wall 115 is pivotally mounted around a central line 116 of the face 105, which line extends orthogonally to the hinge edges of the compartment and substantially at equal distances of the anterior 111, 112 and posterior 113, 114 flanges of the compartment, which flanges are perpendicular to the hinge edges of the compartment and belong to the upper 103 and lower 105 faces of the compartment. The holding wall is rectangular and corresponds to the opening section of the sleeve 102, with a width equal to the length of the flanges 111-114 and with a height equal to the length of the edges 117-120 connecting the hinge edges 107-110.

Indentations are arranged from the anterior flange 111 of the compartment face 103 and from the free flange 121 of the holding wall 115, opposed to its pivoting flange 116, indentations terminated by eyelets for receiving a biasing elastic 127.

Thus, the elastic is passed in a pair of eyelets 128 of the face 103, near the flange 111, and in a pair of eyelets 129 of the holding wall 115, near its free flange 121. The elastic extends here directly from one of the two pairs of eyelets 128, 129 to the other.

Thus, the compartment 100 can switch between a flattened folded condition and an unfolded functional condition open to receive one or more objects. At the functional condition, the compartment comprises two compartments 130, 131, one on each side of the holding wall 115.

In the flat condition, the sleeve faces 102 are in pairs one on the other 103, 104 and 105, 106, after pivoting around the four hinge edges 107-110.

The sleeve is held in the open condition by the holding wall 115 pivoting around its edge 116, orthogonal to the hinge edges, under the action of the elastic 127 which hang the two pairs of eyelets 128, 129 one to the other, the holding wall substantially coming in a perpendicular plan to the four faces 103-106 of the sleeve 102 of the compartment 100, to which it serves as an abutment. The wall 115 is then in an unretracted position for holding the compartment 100 in an open position.

The flattening of the sleeve 102 compartment 101 is done by retracting the wall 115, i.e. by having it pivoting around its hinge edge 116 and by pushing it and retracting it against the lower face 105, moving its free flange 121 closer to the posterior flange 114 of this inner face 105.

The other element 150 is secured to the element 100, herein by sticking. It distinguishes from the associated element 100 by the biasing elastic securing 157 and by the pivoting reversal of the holding wall. The lower face 155 of the sleeve in the compartment 150, as well as the upper face 103 of the compartment 100, comprises a central aperture 158. Moreover, instead of tensioning the elastic 157 between the pair of eyelets 159 of the free flange 161 of the retractable holding wall 160, on one hand, and the pair of eyelets of the lower posterior flange of the lower face 155, on the other hand, by inside the compartment, as previously, the elastic 157 is here passed outside the compartment, through the central aperture 158.

It should be noticed that the pivoting edges of the two walls 115 and 160 of both compartments 100 and 150 are opposed, one below, on FIG. 3, on the lower face 105, the other one, above, on the upper face of the compartment 150 herein mistaken for the lower face of the associated compartment.

It should be noticed, referring to FIG. 3, that if the force of the elastic 127 is not sufficient to make pivoting correctly the holding wall 115, that is to make it come in a plane perpendicular to the faces 103, 105, then the holding wall 115 cannot be insure its shore function between those two ceiling and floor faces. That is why it will be preferred to use the compartment 100, and thus the compartment 150, in a position turned through 90° to that illustrated on FIG. 3, so that the holding wall 115, even if it is not perfectly pivoting, insures all the same its shoring function between the faces, no longer 103 and 105, but between the faces 104 and 106, perpendicular to the faces 103 and 105. In this case, the holding wall 115, in an unretracted position, will still form with these faces 104, 106 a force descending rod to serve as a support for a body of an important weight.

Figure 4:
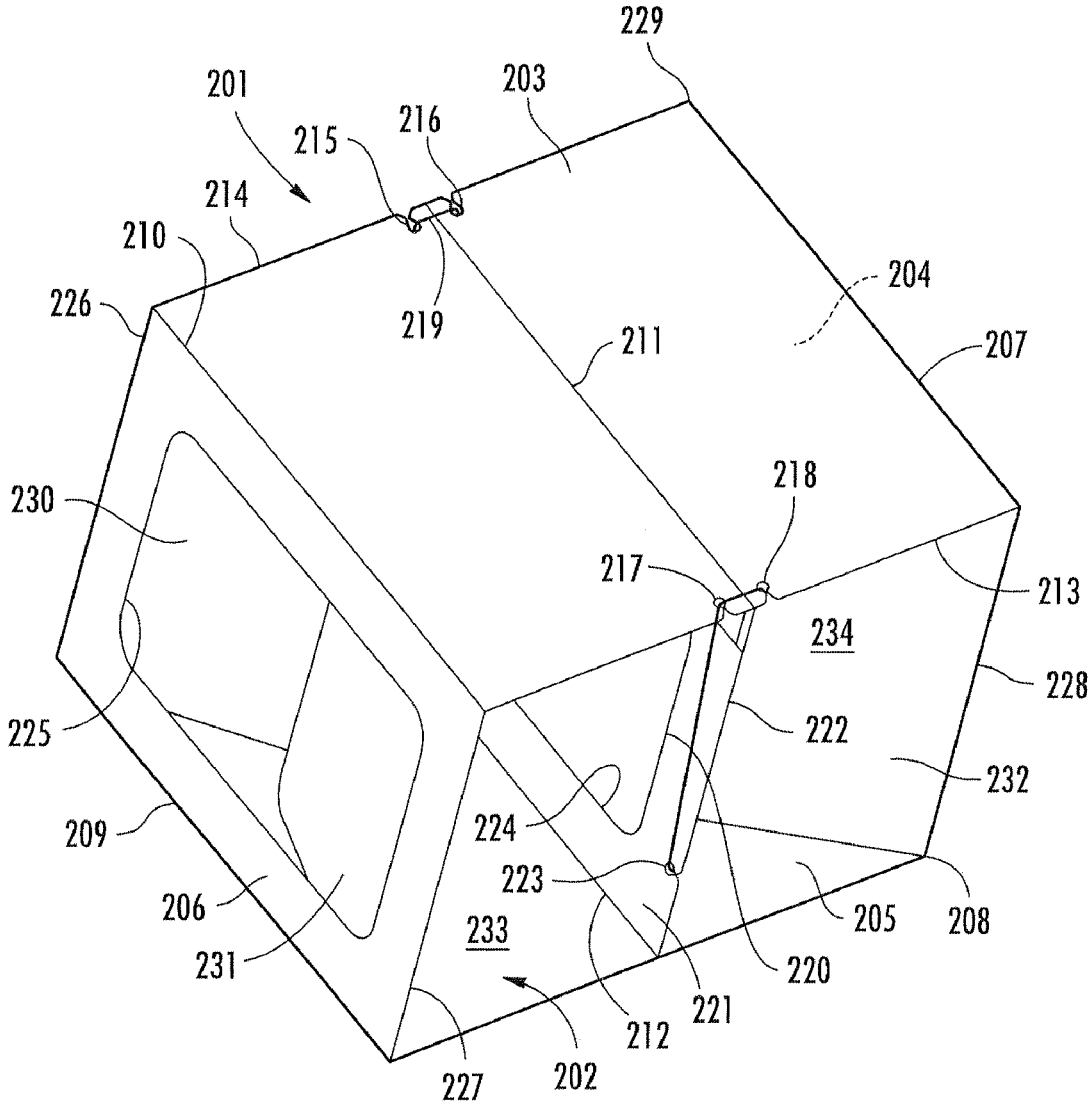
FIG. 4 is a perspective view of a third embodiment of the display elementary support of the invention.

Referring to FIG. 4, the elementary support still comprises a parallelepiped type polyhedral compartment 201, with a sleeve 202 with four faces 203-206 joined by four outer hinge edges 207-210.

Both upper 203 and lower 205 faces can be folded into two parts along two folding, hinge and pivoting inner edges 211, 212, being parallel to the outer hinge edges.

A retractable wall 221, having substantially the same dimensions as the side faces 204, 206 of the sleeve 202, is pivotally mounted around the pivoting lower edge 212 of the lower face 205 of the sleeve 202.

Indentations are arranged in the upper face 203 of the sleeve 202, on either side of the folding line 211 of the face 203 of the sleeve 202, and from the flanges 213, 214, of the face 203 perpendicular to the edges 207, 210, such indentations being terminated by eyelets 215-218 receiving biasing elastics 219, 220. Indentations are also arranged in the retractable wall 221, from its both sides 222 orthogonal to the hinge edges 207-210, near the pivoting edge 212, and which terminates by eyelets 223 receiving biasing elastics 219-220.

In the embodiment of FIG. 4, the retractable wall 221, as well as the side faces 204, 206 of the sleeve 202 are recessed in 224, 225.

Four other retractable walls 230-232 are provided, being pivotally mounted around the sleeve 222 four outer edges 226-229, orthogonal to the hinge edges 207-210.

Thus, the compartment 201 can switch between a flat folded condition and a functional unfolded condition and is open to receive one or more objects.

In the functional condition (FIG. 4), the compartment comprises two compartments 233, 234, one on each side of the retractable wall 221, in unretracted position, raised and holding the upper 203 and lower 205 faces, along the lines 211, 212, faces with which the retractable wall forms a force descending rod to serve as support to a body of an important weight.

This raised position of the median wall 221 has been reached under the action of the biasing elastics 219, 220. To improve the holding of the sleeve 202 in its parallelepiped form, the secondary holding walls 230-232 have been pivoted around their pivoting edges, from their positions pressed against the side faces 206, 204 up to their position holding the upper 203 and lower 205 faces, substantially orthogonal to the faces 203-206 of the sleeve 202.

The flattening of the compartment 201 is done by folding down the secondary holding walls 230-232 against the sleeve side faces and, against the action of the biasing elastics 219-220, by pivoting the median holding wall 221 around its pivoting edge 212. During this flattening, both faces 203, 205 are folded in two parts along lines 211, 212, both side faces 204, 206 abutting one against the other with the interposition of the free upper part of the median holding wall 221.

The invention claimed is:

1. An apparatus comprising a polyhedral sleeve forming at least one compartment, wherein the polyhedral sleeve has a plurality of hinged edges for switching between a flat folded condition and an unfolded weight-bearing condition, wherein the polyhedral sleeve comprises at least one floor face and at least one ceiling face; and at least one median wall, positioned within the at least one compartment and extending from the at least one floor face to the at least one ceiling face, wherein the at least one median wall is elastically biased by at least one biasing elastic element to hold the polyhedral sleeve in the unfolded weight-bearing condition, wherein the at least one ceiling face comprises at least one first eyelet for receiving the at least one biasing elastic element, wherein the at least one biasing elastic element is connected to the at least one ceiling face at the at least one first eyelet, wherein the at least one median wall comprises at least one second eyelet for receiving the at least one biasing elastic element, and wherein the at least one biasing elastic element is connected to the at least one median wall at the at least one second eyelet.

2. The apparatus of claim 1, wherein the at least one biasing elastic element biases the at least one median wall toward the at least one ceiling face.

3. The apparatus of claim 1, wherein the at least one median wall is arranged to pivot around an edge orthogonal to the plurality of hinged edges of the polyhedral sleeve.

4. The apparatus of claim 1, wherein the at least one median wall wall is pivotally mounted around an outer edge of the polyhedral sleeve.

5. The apparatus of claim 1, wherein the at least one median wall wall is pivotally mounted around an edge inner to the polyhedral sleeve.

6. The apparatus of claim 1, wherein the at least one compartment comprises a single compartment.

7. The apparatus of claim 1, wherein the at least one compartment comprises two compartments.

8. The apparatus of claim 1, wherein the at least one median wall is pivotally mounted around an edge parallel to the plurality of hinged edges of the polyhedral sleeve.

9. The apparatus of claim 1, wherein the at least one median wall wall is recessed from the faces of the at least one compartment that are parallel to said at least one median wall in the flat folded condition and in the unfolded weight bearing condition.

10. The apparatus of claim 1, comprising at least one secondary holding wall pivotally freely mounted around an outer edge of the polyhedral sleeve.

* * * * *